US006695889B2

(12) United States Patent
Sakamoto et al.

(10) Patent No.: US 6,695,889 B2
(45) Date of Patent: Feb. 24, 2004

(54) PRE-DYEING TREATMENT PROCESS AND DYEING PROCESS FOR TEXTILE PRODUCTS CONTAINING HIGHLY CROSSLINKED POLYACRYLIC FIBERS, PRETREATED AND UNDYED TEXTILE PRODUCT, AND DYED TEXTILE PRODUCT

(75) Inventors: Takamasa Sakamoto, Kyoto (JP); Tsutomu Shiotani, Hyogo (JP); Takeshi Ogino, Osaka (JP)

(73) Assignees: Sakaren Co., Ltd., Kyoto (JP); Mizuno Corp., Osaka (JP)

( * ) Notice: Subject to any disclaimer, the term of this patent is extended or adjusted under 35 U.S.C. 154(b) by 0 days.

(21) Appl. No.: 09/951,497

(22) Filed: Sep. 14, 2001

(65) Prior Publication Data

US 2002/0059683 A1 May 23, 2002

(30) Foreign Application Priority Data

Sep. 18, 2000 (JP) ..... 2000-324749

(51) Int. Cl.[7] ..... D06P 3/70

(52) U.S. Cl. ..... 8/534; 8/594; 8/115.56; 8/927; 8/930; 8/934

(58) Field of Search ..... 8/529, 534, 930, 8/927, 934, 115.56, 594

(56) References Cited

U.S. PATENT DOCUMENTS

| | | | |
|---|---|---|---|
| 5,292,822 A | | 3/1994 | Tanaka et al. |
| 5,783,304 A | * | 7/1998 | Nakajima et al. |
| 5,853,879 A | | 12/1998 | Takamiya et al. |

* cited by examiner

*Primary Examiner*—Margaret Einsmann
(74) *Attorney, Agent, or Firm*—Heller Ehrman White and McAuliffe

(57) ABSTRACT

In textile products (e.g. yarns, woven fabrics, knit fabrics) comprising highly crosslinked polyacrylic fibers (made of acrylic fibers by partially hydrolyzing a nitrile group to generate an amido group and a carboxylic acid group), fibers blended with the highly crosslinked polyacrylic fibers can be dyed in an even hue.

A pre-dyeing treatment process for such textile products (e.g. yarns, woven fabrics, knit fabrics) comprising highly crosslinked polyacrylic fibers comprises a pretreatment step of immersing the textile product into an acidic solution and treating it at a high temperature and an elevated pressure. A dyeing process comprises the steps of conducting this pre-dyeing treatment process, and thereafter conventionally dyeing fibers blended with the highly crosslinked polyacrylic fibers. A pretreated and undyed textile product and a dyed textile product are obtained by the pre-dyeing treatment process and the dyeing process mentioned above, respectively.

27 Claims, No Drawings

PRE-DYEING TREATMENT PROCESS AND DYEING PROCESS FOR TEXTILE PRODUCTS CONTAINING HIGHLY CROSSLINKED POLYACRYLIC FIBERS, PRETREATED AND UNDYED TEXTILE PRODUCT, AND DYED TEXTILE PRODUCT

BACKGROUND OF THE INVENTION

1. Field of the Invention

The present invention relates to a pre-dyeing treatment process and a dyeing process for textile products comprising highly crosslinked polyacrylic fibers. This invention also relates to a pretreated and undyed textile product and a dyed textile product obtained by these processes.

2. Prior Art

Recently, a number of functional goods with cleanliness and comfortability have been developed. Among them, particular attention is paid to a textile product in which highly crosslinked polyacrylic fibers are blended to impart antibacterial and deodorizing properties (e.g. U.S. Pat. Nos. 5,853,879 and 5,292,822).

The highly crosslinked polyacrylic fiber has a peculiar chemical structure including a carboxylate. Since this chemical structure can provide a pH buffering capacity and such functions as antibacterial and deodorizing properties, a textile product containing this type of fibers is expected to serve in a broader applications. At the same time, however, the pH control capacity renders dyeing of such textile products extremely difficult. Therefore, these textile products have been dyed in the following manners.

(1) Acid or alkali is added, in advance, to a dye solution in a sufficient amount to block the pH buffering capacity of the highly crosslinked polyacrylic fiber. Then, an item to be dyed is immersed into the acid- or alkali-added dye solution and dyed therein.

(2) Acid or alkali is appropriately added in portions to a dye solution, simultaneously with the dyeing treatment of a textile product comprising highly crosslinked polyacrylic fibers. While the acid or alkali suppresses the pH buffering capacity of the highly crosslinked polyacrylic fibers, other fibers blended in the textile product can be dyed.

In the process (1), the amount of acid or alkali should be adjusted every time the dyeing condition is altered (e.g. type of blended fibers, blending ratio, type of dyes, dye concentration, bath ratio). Eventually, dye solutions are unstable and cause dyeing spots. The hue of the resultant products is unstable, poorly reproducible, and widely different from one dyeing lot to the other.

The pH buffering capacity of the highly crosslinked polyacrylic fiber is variable depending on the type of fibers to be blended with the highly crosslinked polyacrylic fiber. Hence, in the process (2), it is complicated to add acid or alkali properly in portions and thus difficult to control the pH. Similarly, the process (2) results in dyeing spots and apparent hue unevenness, thus being unsuitable for commercial production.

SUMMARY OF THE INVENTION

As described above, it is extremely difficult to dye a textile product which comprises highly crosslinked polyacrylic fibers. Bearing this issue in mind, the present inventors have made intensive researches to find a dyeing process which can simply and constantly provide a desired dyed product, and finally reached the present invention.

The present invention provides a pre-dyeing treatment process for textile products, such as yarns, woven fabrics and knit fabrics, comprising highly crosslinked polyacrylic fibers. This process comprises a pretreatment step of immersing the textile product into an acidic solution and treating the textile product at a high temperature and an elevated pressure. The pretreatment step is conducted at a high temperature ranging from 105 to 140° C. and an elevated pressure ranging from 1.5 to 2 atm. The pre-dyeing treatment process may further comprise the step of washing the pretreated textile product with water, and the step of drying the washed textile product.

A pretreated and undyed textile product of the present invention is obtained by the pre-dyeing treatment process as mentioned above.

The present invention also provides a dyeing process for textile products comprising highly crosslinked polyacrylic fibers. This dyeing process comprises the steps of conducting the above-mentioned pre-dyeing treatment process and thereafter conventionally dyeing fibers blended with the highly crosslinked polyacrylic fibers.

A dyed textile product of the present invention is obtained by the above dyeing process.

According to the present invention, the pH buffering capacity of the highly crosslinked polyacrylic fibers is restrained during the dyeing treatment. In the meantime, the fibers blended with the highly crosslinked polyacrylic fibers can be dyed in a stable hue. It should be noted that the highly crosslinked polyacrylic fibers have their pH buffering capacity restrained temporarily, that is, only during the dyeing treatment. After the dyeing treatment, the restrained pH buffering capacity recovers in time for the final treatment of the textile product. As a result, the finished textile product is a high-quality product dyed in a stable hue, and exhibits the properties deriving from the highly crosslinked polyacrylic fibers such as moisture absorbency, antibacterial property and deodorizing property. With the high functionality and excellent design freedom, the textile product can be utilized widely in clothing applications.

The present invention is hereinafter described in detail.

The textile products as termed in this invention include yarns, yarn combination, textiles of yarn combination, knit fabrics and nonwoven cloth in any of which highly crosslinked polyacrylic fibers are mix-spun or blended with one or more types of fibers selected from synthetic fibers such as polyester fibers, polyamide fibers and polyacrylic fibers; regenerated cellulosic fibers including wet cellulosic fibers (e.g. rayon, cupro and polynosic fibers) and dry cellulosic fibers (e.g. Tencel, Lyocell); cotton, hemp, wool, silk, etc.

These textile products are utilized in underwear, socks, gloves, muffler and the like, and also in sportswear, men's clothes, nightwear- and bedding-related products (e.g. pajamas, futon covers, bedcovers, towels, sheets, pillow covers), curtains, seat covers, car seat covers, cushion covers, architectural decoration-related products, shoe insoles, shoe linings, etc.

In the context of the present invention, the highly crosslinked polyacrylic fiber indicates a fiber prepared from an acrylic fiber by partially hydrolyzing its nitrile group to generate an amido group and a carboxylic acid group, which in turn are partially crosslinked with hydrazines or the like. After the crosslinking treatment with hydrazines, the nitrogen content normally increases by 1.0 to 10.0% by weight. The carboxylic acid group is introduced in an amount of 1.0 to 5.0 mmol/g, whereas an amido group is introduced into the remaining portion. This fiber has a pH buffering capacity to keep the pH constantly between 7.5 and 8.0, and also possesses moisture absorbency, antibacterial property, deodorizing property and the like.

The pretreatment step comprises the steps of preparing a treatment solution for the highly crosslinked polyacrylic fiber in an acid concentration of 0.02 to 0.06 mol/l, immersing a textile product into the treatment solution, and treating the textile product in the treatment solution at 105 to 140° C. under 1.5 to 2 atm for a period of 10 to 80 minutes.

In this pretreatment step, acids for the treatment solution include common inorganic acids and organic acids, preferably organic acids with a high buffering capacity. Typical examples of the organic acids are acetic acid, citric acid, malic acid, etc. In particular, acetic acid is desirable in terms of cost and workability.

The acid concentration of the pretreatment solution is in the range of 0.02 to 0.06 mol/l. At a concentration lower than 0.02 mol/l, Na ions in the terminal carboxyl group cannot be sufficiently substituted with hydrogen. On the contrary, when the concentration exceeds 0.06 mol/l, the effect does not improve any further.

During the pretreatment step, the temperature of the treatment solution is adjusted between 105 to 140° C., preferably between 135 to 140° C. When the temperature is lower than 105° C., Na ions in the terminal carboxyl group of the highly crosslinked polyacrylic fiber cannot be sufficiently substituted with hydrogen. On the other hand, a temperature over 140° C. causes deterioration of the highly crosslinked polyacrylic fiber, which may turn yellow or harden.

Further, the pressure applied to the pretreatment solution is in the range of 1.5 to 2 atm. At a pressure below 1.5 atm, Na ions in the terminal carboxyl group of the highly crosslinked polyacrylic fiber cannot be sufficiently substituted with hydrogen. Nevertheless, even when the pressure is raised over 2 atm, the result does not improve any further.

The treating time in the pretreatment step can be determined between 10 and 80 minutes. Less than 10 minutes, the terminal carboxylate in the highly crosslinked polyacrylic fiber cannot be substituted with hydrogen in a satisfactory and stable manner. On the other hand, it is a waste of time to continue the treatment over 80 minutes, by which time the terminal substitution reaction has finished.

The above-mentioned pretreatment step is followed by the washing step of washing the pretreated textile product with water. The washing method is not particularly limited, as far as being capable of washing away the acid deposited during the pretreatment step on the fibers that are blended with the highly crosslinked polyacrylic fibers. For example, the textile product may be dip-washed in a water bath, or washed with sprinkled water while conveyed under a shower or the like.

The washing step is followed by the drying step of drying the washed textile product. Similarly, the drying method is not particularly limited, as far as being capable of drying the textile product which has been wetted in the washing step. The drying method includes hot air drying, heat drying, solar drying and air drying, to name a few.

In the present invention, the pretreated and undyed textile product encompasses any product obtained after the pretreatment step, the washing step or the drying step.

It is important to note, however, that the pretreated and undyed textile product should be dyed immediately after the pretreatment step. Otherwise, the acid which remains deposited on the pretreated and undyed textile product deteriorates the fibers blended with the highly crosslinked polyacrylic fibers. Once the pretreated and undyed textile has gone through the washing step, where the deposited acid is washed off, it is not necessary to dye the pretreated and undyed textile product instantly. Nevertheless, the washed textile product, still in the wet state, should not be left for a long period, so as to avoid development of mold. For these reasons, if the textile product is shipped to another factory or left for a while before the dyeing treatment, it is preferable to subject the pretreated textile product to the drying step.

Any of the above pretreated and undyed textile products can be dyed in a conventional manner as applied to the fibers which are blended with the highly crosslinked polyacrylic fibers in the pretreated and undyed textile product.

In a conventional dyeing method, use can be made of common dyes and auxiliaries which have been used for the blended fibers, regardless of the presence of the highly crosslinked polyacrylic fibers. Exemplary dyeing methods are dip dyeing (resisted yarn dyeing, cheese dyeing, knit fabric dyeing, woven fabric dyeing, product dyeing), continuous dyeing, printing, transfer printing and the like.

For continuous dyeing, printing and transfer printing, it is desirable to use the pretreated and undyed textile product which is obtained after the drying step, so as to prevent the deposited acid and moisture from interfering with the dyeing treatment. In contrast, in the case of dip dyeing, there is no disadvantage in using the pretreated and undyed textile product after the pretreatment step or the washing step, because the soaping treatment is usually carried out before the dyeing treatment. As an example, Table 1 lists general dyeing conditions in dip dyeing, based on the type of fibers which are blended with the highly crosslinked polyacrylic fibers in the pretreated and undyed textile product.

TABLE 1

| Blended Fiber | Soaping treatment | Dye and Auxiliary | Temp. (° C.) | Time (min.) | Post-treatment | Temp. (° C.) | Time (min.) |
|---|---|---|---|---|---|---|---|
| polyester | soaping | disperse dye | 130–135 | 50–90 | reduction cleaning*4 | 80 | 20 |
| | | disperse dye, dispsersing agent | 130–135 | 50–90 | | | |
| cationic dyeable polyester | soaping | cationic dye | 100–120 | 45–80 | reduction cleaning*5 | 80 | 20 |
| | | cationic dye, levelling agent | 100–120 | 45–80 | | | |
| polyamide | soaping | acid dye | 100 | 45–60 | fixation treatment*6 | 60–70 | 20 |
| | | acid dye, levelling agent | 100 | 45–60 | | | |
| | | acid dye, levelling agent, retarding agent | 100 | 45–60 | | | |
| acrylic fiber | soaping | cationic dye | 100 | 45–60 | — | — | — |
| | | cationic dye, levelling agent | 100 | 45–60 | | | |

TABLE 1-continued

| Blended Fiber | Soaping treatment | Dye and Auxiliary | Temp. (° C.) | Time (min.) | Post-treatment | Temp. (° C.) | Time (min.) |
|---|---|---|---|---|---|---|---|
| wool | soaping*1 | acid dye | 100 | 30–60 | — | — | — |
| | | acid dye, levelling agent | 100 | 30–60 | | | |
| | soaping + felting inhibitor | chrome dye | 100 | 30–60 | chroming and soaping*7 | — | — |
| | | chrome dye, levelling agent | 100 | 30–60 | | | |
| cellulosic fiber | soaping*2 | reactive dye, levelling agent, mirabilite | 60–80 | 60–80 | neutralization | 60–70 | 10 |
| | | | | | soaping | 80 | 20 |
| | soaping + hydrogen bleach | reactive dye, levelling agent, mirabilite, alkali fixing agent | 60–80 | 60–80 | hot water wash | 80 | 20 |
| | | direct dye | 100 | 45–90 | fixation treatment*8 | 20–25 | 30 |
| | soaping + chlorine bleach | direct dye, levelling agent, mirabilite | 100 | 45–90 | | | |
| polyester/ cellulose | soaping*3 | (A) disperse dye | 130–135 | 60–90 | reduction cleaning*9 | 80 | 20 |
| | | (A) disperse dye, dispersing agent | 130–135 | 60–90 | | | |
| | soaping + hydrogen bleach | (B) reactive dye, levelling agent, mirabilite | 60–80 | 60–80 | neutralization | 60–70 | 10 |
| | | | | | soaping | 80 | 20 |
| | | (B) reactive dye, levelling agent, mirabilite, alkali fixing agent | 60–80 | 60–80 | warm water wash | 80 | 20 |
| | soaping + chlorine bleach | (B) direct dye | 100 | 45–90 | fixation treatment*10 | 20–25 | 30 |
| | | (B)direct dye, levelling agent, mirabilite | 100 | 45–90 | | | |

(A) for dyeing of polyester components
(B) for dyeing of cellulose components
*1A felting inhibitor may be employed, as necessary.
*2,*3Hydrogen bleach or chlorine bleach may be combined with soaping, as necessary.
*4,*5,*6,*8,*9,*10Post-treatment may be omitted in some cases.
*7Post-treatment is required only when a chrome dye is employed.

As prescribed in Table 1, the pretreated and undyed textile product can be dyed into an even and stable hue, in a conventional manner selected in accordance with the type of fibers blended with the highly crosslinked polyacrylic fibers.

Any of the above traditional dyeing methods is understood to be inclusive of the soaping treatment before dyeing and the post-treatment after dyeing.

The soaping treatment may be combined with either hydrogen bleach or chlorine bleach, depending on the type of blended fibers. In one soaping treatment, for example, soaping and hydrogen bleach precede the dyeing treatment. In another case, the soaping treatment and the dyeing treatment may be repeated several times (e.g. in the order of soaping, dyeing, hydrogen bleach and dyeing). In some cases, the soaping treatment may be omitted at all.

The post-dyeing treatment is performed to remove the unexhausted dye on the surface of the textile product. The post-dyeing treatment is determined according to the type of blended fibers, because they have been dyed in different manners. To give a few examples, reduction cleaning is suitable where polyester fibers or cationic dyeable polyester fibers are blended. Neutralization and soaping are combined where cellulosic fibers or polyester/cellulose fibers are blended. Once the unexhausted dye is removed, the textile product is completed with treatments like fixation, softening finish and drying, as necessary.

In the resulting textile product, the pH buffering capacity of the highly crosslinked polyacrylic fiber is constrained during the dyeing treatment. Notably, this effect lasts only temporarily and not permanently. To be specific, the inherent properties of the highly crosslinked polyacrylic fiber are suppressed during the dyeing treatment, but recovered in the course of the post-dyeing treatment and the like. As a consequence, the final textile product is dyed fixedly, without sacrificing the moisture absorbency, antibacterial property, deodorizing property and other qualities attributable to the highly crosslinked polyacrylic fiber.

DETAILED DESCRIPTION OF THE INVENTION

Now, the present invention is described in greater detail by way of preferred examples.

Using a knitting machine (22G×30"ϕ), single yarns (yarn count: 30), obtained by evenly mix-spinning the highly crosslinked polyacrylic fiber (15%) and a polyester (85%), were woven into a piece of knit fabric which weighed about 10 kg, 220 g/m$^2$. This knit fabric was immersed in a jet dyeing machine, scoured at 90° C., and washed with water. Afterwards, the fabric was dried in a dryer to give an item to be dyed.

[Pre-dyeing treatment]

Acetic acid treatment solutions were prepared at nine degrees of concentration: 0.0057 mol/l, 0.0113 mol/l, 0.0227 mol/l, 0.0340 mol/l, 0.0453 mol/l, 0.0567 mol/l, 0.0680 mol/l, 0.0907 mol/l and 0.1133 mol/l.

In a dyeing tester (MINI-COLOR, manufactured by TEXAM Co., LTD.), the item to be dyed (10 g) was placed into each of the acetic acid treatment solutions at a bath ratio of 1:20. After ten minutes of immersion, each treatment solution was heated to 60° C. over a period of 20 minutes, at which temperature the treatment was continued for 30 minutes. Thereafter, each item to be dyed was taken out of the dyeing tester and washed with water. Thus obtained was a pretreated item to be dyed which was subjected to the pre-dyeing treatment with acetic acid.

In the course of this procedure, the pH of the pretreatment solution of each acetic acid concentration was measured in the starting bath, in the bath 10 minutes after immersion of the item to be dyed, and in the finishing bath.

The measurement values are given in Table 2 below.

Additionally, similar pretreated items to be dyed were obtained by the above pre-dyeing treatment, except for changing the treating temperature to 100° C. and 130° C.

The pH of the pretreatment solution of each acetic acid concentration was measured in the starting bath, in the bath 10 minutes after immersion of the item, and in the finishing bath.

In the case of the 100° C. pretreatment, the treatment solution was first heated up to 100° C. over a period of 30 minutes. Then, each item to be dyed was treated therein for 30 minutes at 100° C. Finally, the solution was cooled down to 80° C. for measurement of the pH in the finishing bath.

For the 130° C. pretreatment, the treatment solution was first heated up to 130° C. over a period of 50 minutes. Then, each item to be dyed was treated therein for 30 minutes at 130° C. Finally, the solution was cooled down to 80° C. for measurement of the pH in the finishing bath.

The measurement values are given in Table 2.

TABLE 2

| Amount of acetic acid for pretreatment (mol/l) | pH after pH in starting bath | 10-mins. of undyed item immersion | pH in pretreatment finishing bath 60° C. | 100° C. | 130° C. |
|---|---|---|---|---|---|
| 0.0057 | 3.8 | 6.0 | 7.1 | 7.1 | 7.3 |
| 0.0113 | 3.5 | 5.7 | 6.3 | 6.3 | 6.6 |
| 0.0227 | 3.2 | 5.1 | 5.3 | 5.3 | 5.3 |
| 0.0340 | 3.1 | 4.7 | 4.7 | 4.7 | 4.7 |
| 0.0453 | 3.0 | 4.5 | 4.5 | 4.5 | 4.5 |
| 0.0567 | 2.9 | 4.3 | 4.3 | 4.3 | 4.3 |
| 0.0680 | 2.8 | 4.2 | 4.2 | 4.2 | 4.2 |
| 0.0907 | 2.7 | 4.0 | 4.0 | 4.0 | 4.0 |
| 0.1133 | 2.7 | 3.9 | 3.9 | 3.9 | 3.9 |

[Dyeing treatment]

Each of the pretreated items to be dyed and a dye solution for polyester fibers were fed into a dyeing tester (MINI-COLOR, manufactured by TEXAM CO., LTD.) at a bath ratio of 1:20. The pretreated item was soaked in the dye solution for 10 minutes. Then, the solution was heated to 135° C. over a period of 50 minutes, at which temperature the dyeing treatment was effected for 30 minutes. Thereafter, the dye solution was cooled slowly, and the item was washed thoroughly with water.

According to the acetic acid concentration, the pH of each dye solution was measured in the starting bath, in the bath 10 minutes after immersion of the pretreated items, and in the finishing bath where the solution was cooled down to 50° C. after the completion of dyeing.

As the reduction treatment to be conducted after the dyeing treatment, the dyed item was put into the dyeing tester (MINI-COLOR, manufactured by TEXAM CO., LTD.) and immersed in a reduction treatment solution at a bath ratio of 1:20. After 10 minutes of immersion, the solution was heated up to 80° C. in 10 minutes to effect the reduction treatment. Following the reduction treatment, the dyed item was placed in the dyeing tester (MINI-COLOR, manufactured by TEXAM CO., LTD.) and immersed in a softening treatment solution at a bath ratio of 1:20. After 10 minutes of immersion at an ambient temperature, a series of dyeing steps was finished with centrifugal extraction and hot air drying.

For each pretreatment solution which differed in the acetic acid concentration, the above-described dyeing treatment was repeated to dye five pretreated items. The dyed items were visually evaluated for reproducibility and uniformity of dyeing and ranked in four grades (excellent, good, fair and poor).

For the dye solution, a gray disperse dye was prepared by mixing 0.014% owf of blue disperse dye (manufactured by Sumitomo Chemical Co., Ltd.), 0.0044% owf of red disperse dye (manufactured by Sumitomo Chemical Co., Ltd.), and 0.003% owf of yellow disperse dye (manufactured by Mitsubishi Kasei Kogyo Kabushiki Kaisha). Apart from this, a one-liter solution mixture was prepared by adding 1 g/l ows of dispersing agent (IONET R-1, manufactured by Sanyo Chemical Industries, Ltd.) and 0.00453 mol/l of acetic acid. The dye solution was obtained by feeding the gray disperse dye and 200 cc of the solution mixture into the dyeing tester.

As the reduction treatment solution, a one-liter solution mixture was prepared by adding 2 g of causic soda, 2 g of hydrosulfite and 1 g of activator (detergent). In use, 200 cc of this solution mixture was fed into the dyeing tester. For the softening treatment solution, 3 g of polyethylene wax softening agent was added to give a one-liter solution mixture. Likewise, 200 cc of the solution mixture was added into the dyeing tester.

Tables 3 and 4 show the results of the pH measurement and the reproducibility/uniformity evaluation.

TABLE 3

| Amount of acetic acid for pretreatment (mol/l) | pH of dye solution before immersion of pretreated fabric | pretreatment at 60° C. pH after 10-min. immersion of pretreated fabric | pH in finishing bath | pretreatment at 100° C. pH after 10-min. immersion of pretreated fabric | pH in finishing bath | pretreatment at 130° C. pH after 10-min. immersion of pretreated fabric | pH in finishing bath |
|---|---|---|---|---|---|---|---|
| 0.0057 | 4.2 | 5.2 | 6.2 | 5.7 | 6.7 | 5.8 | 6.6 |
| 0.0113 | 4.2 | 5.1 | 6.0 | 5.3 | 6.2 | 5.5 | 6.1 |
| 0.0227 | 4.2 | 4.7 | 5.7 | 4.6 | 5.4 | 4.9 | 4.9 |
| 0.0340 | 4.2 | 4.5 | 5.6 | 4.5 | 5.3 | 4.6 | 4.6 |
| 0.0453 | 4.2 | 4.4 | 5.5 | 4.4 | 5.3 | 4.5 | 4.6 |
| 0.0567 | 4.2 | 4.3 | 5.4 | 4.3 | 5.2 | 4.4 | 4.5 |
| 0.0680 | 4.2 | 4.3 | 5.4 | 4.3 | 5.2 | 4.4 | 4.5 |
| 0.0907 | 4.2 | 4.2 | 5.3 | 4.3 | 5.2 | 4.3 | 4.4 |
| 0.1133 | 4.2 | 4.2 | 5.3 | 4.3 | 5.2 | 4.2 | 4.3 |

TABLE 4

| Amount of acetic acid for pretreatment (mol/l) | Reproducibility 60° C. | 100° C. | 130° C. | Uniformity 60° C. | 100° C. | 130° C. |
|---|---|---|---|---|---|---|
| 0.0057 | poor | poor | fair | poor | poor | fair |
| 0.0113 | poor | poor | good | poor | poor | excellent |
| 0.0227 | poor | poor | excellent | poor | fair | excellent |
| 0.0340 | poor | poor | excellent | poor | fair | excellent |
| 0.0453 | poor | poor | excellent | poor | fair | excellent |
| 0.0567 | poor | poor | excellent | poor | fair | excellent |
| 0.0680 | poor | poor | excellent | poor | fair | excellent |
| 0.0907 | poor | poor | excellent | poor | good | excellent |
| 0.1133 | poor | poor | excellent | poor | good | excellent |

COMPARATIVE EXAMPLES

In Comparative Examples, the items to be dyed were not pretreated with acetic acid. Each of the non-pretreated items and a dye solution for polyester fibers were fed into the dyeing tester (MINI-COLOR, manufactured by TEXAM CO., LTD.) at a bath ratio of 1:20. After ten minutes of immersion, the dye solution was heated to 135° C. in 50 minutes, at which temperature the dyeing treatment was effected for 30 minutes. Thereafter, the dye solution was cooled slowly, and the item was washed thoroughly with water.

According to the acetic acid concentration, the pH of the dye solution was measured in the starting bath, in the bath 10 minutes after immersion of the non-pretreated items to be dyed, and in the finishing bath where the solution was cooled down to 50° C. after the completion of dyeing.

After the dyeing treatment, the dyed items were subjected to the reduction treatment and the softening treatment as mentioned above. Subsequently, a series of dyeing steps was finished with centrifugal extraction and hot air drying.

For each dye solution which differed in the acetic acid concentration, this dyeing treatment was repeated to dye five non-pretreated items. The dyed items were visually evaluated for reproducibility and uniformity of dyeing and ranked in four grades (excellent, good, fair and poor).

As for the dye solutions, the concentration of acetic acid was adjusted to nine degrees: 0.0057 mol/l, 0.0113 mol/l, 0.0227 mol/l, 0.0340 mol/l, 0.0453 mol/l, 0.0567 mol/l, 0.0680 mol/l, 0.0907 mol/l and 0.1133 mol/l. The solutions for the reduction treatment and the softening treatment were similar to those used in the above examples.

The results are shown in Table 5.

TABLE 5 pH fluctuations in dye solutions (without the acetic acid pretreatment)

| Amount of acetic acid in dye bath (mol/l) | pH of dye bath and starting bath | pH after 10-min. immersion of item to be dyed | pH in finishing bath (dyeing completed) | Reproducibility | Uniformity |
|---|---|---|---|---|---|
| 0.0057 | 4.1 | 6.2 | 7.3 | poor | poor |
| 0.0113 | 3.8 | 5.9 | 6.8 | poor | poor |
| 0.0227 | 3.5 | 5.2 | 5.7 | poor | poor |
| 0.0340 | 3.0 | 4.8 | 5.1 | poor | fair |
| 0.0453 | 3.0 | 4.6 | 4.8 | poor | fair |
| 0.0567 | 3.0 | 4.4 | 4.6 | poor | fair |
| 0.0680 | 3.0 | 4.2 | 4.4 | fair | fair |
| 0.0907 | 2.9 | 4.1 | 4.2 | fair | fair |
| 0.1133 | 2.9 | 4.0 | 4.1 | fair | fair |

[Comparison of effects]

Judging from the pH measured after the pretreatment, the acetic acid pretreatment at low temperatures (60° C., 100° C.) appears to be capable of restraining the pH buffering capacity of the highly crosslinked polyacrylic fiber. As a matter of fact, however, the highly crosslinked polyacrylic fiber recovers its original pH buffering capacity during the dyeing treatment at 135° C. Since the pH of the dye solution shifts widely before and after the dyeing treatment, it is difficult to accomplish the dyeing treatment under stable pH conditions. After all, the dyed items lack hue reproducibility and uniformity.

The acetic acid pretreatment at a high temperature (130° C.) still fails to constrain the pH buffering capacity of the highly crosslinked polyacrylic fiber, when the pretreatment solution has a low acetic acid concentration (0.0113 mol/l or lower). In this case, the pH in the dyeing bath shifts considerably during the dyeing treatment at 135° C. In contrast, where the pretreatment is performed at 130° C. with the use of an acetic acid solution in a concentration of 0.0227 mol/l or higher, the dyeing bath remains stable throughout the dyeing treatment at 135° C., showing merely slight pH fluctuations. With a stable dyeing bath, the products can be dyed in a stable hue.

On the other hand, where the acetic acid pretreatment is skipped before the dyeing treatment, the pH buffering capacity of the highly crosslinked polyacrylic fiber cannot be reduced enough. Therefore, regardless of the acetic acid concentration in the dye solution, the pH in the dyeing bath fluctuates drastically during the dyeing treatment at 135° C. The resultant dyed items fails in hue reproducibility nor uniformity.

[pH buffering capacity]

Of the items dyed according to the above dyeing treatments, those with desirable results were tested for the recovery of the pH buffering capacity which had been repressed during the dyeing treatment.

For this test, samples were prepared by cutting the dyed items with desirable results (i.e. the items dyed after the 130° C. pretreatment) into 15 mm×15 mm (about 0.05 g)

Each sample was soaked in 0.5 ml of test solution in a pH meter (Twin pH meter, manufactured by Horiba Ltd). The pH was measured after 1, 3, 5 and 10 minutes to check its change.

For comparison, similar tests were carried out with the use of items which were dyed after the 130° C. pretreatment but which did not go through the reduction treatment and subsequent post-dyeing treatments.

As the test solution, acetic acid at pH 4.9 and sodium tripolyphosphate at pH 9.1 were employed. The results are compiled in Table 6.

TABLE 6

| Test solution | Amount of acetic acid for 130° C. pretreatment (mol/l) | pH without reduction treatment | | | | pH after reduction treatment | | | |
|---|---|---|---|---|---|---|---|---|---|
| | | 1 min. | 3 mins. | 5 mins. | 10 mins. | 1 min. | 3 mins. | 5 mins. | 10 mins. |
| Acetic acid (pH 4.9) | 0.0057 | 5.1 | 5.2 | 5.3 | 5.5 | 5.4 | 6.1 | 6.4 | 6.9 |
| | 0.0113 | 5.1 | 5.2 | 5.3 | 5.5 | 5.4 | 6.1 | 6.4 | 6.9 |
| | 0.0227 | 5.1 | 5.2 | 5.2 | 5.5 | 5.4 | 6.1 | 6.4 | 6.9 |
| | 0.0340 | 5.1 | 5.1 | 5.2 | 5.4 | 5.3 | 6.0 | 6.4 | 6.9 |
| | 0.0453 | 5.1 | 5.1 | 5.2 | 5.4 | 5.3 | 5.9 | 6.3 | 6.8 |
| | 0.0567 | 5.0 | 5.1 | 5.2 | 5.3 | 5.2 | 5.9 | 6.3 | 6.8 |
| | 0.0680 | 5.0 | 5.1 | 5.2 | 5.3 | 5.2 | 5.8 | 6.2 | 6.7 |
| | 0.0907 | 5.0 | 5.1 | 5.2 | 5.3 | 5.1 | 5.7 | 6.0 | 6.6 |
| | 0.1133 | 5.0 | 5.1 | 5.2 | 5.2 | 5.0 | 5.5 | 5.8 | 6.4 |
| Sodium tripolyphosphate (pH 9.1) | 0.0057 | 9.0 | 8.8 | 8.8 | 8.5 | 8.6 | 7.8 | 7.5 | 7.0 |
| | 0.0113 | 9.0 | 8.8 | 8.8 | 8.5 | 8.6 | 7.8 | 7.4 | 6.9 |
| | 0.0227 | 9.0 | 8.8 | 8.8 | 8.6 | 8.7 | 7.8 | 7.4 | 6.9 |
| | 0.0340 | 9.0 | 8.8 | 8.8 | 8.6 | 8.5 | 7.9 | 7.5 | 7.2 |
| | 0.0453 | 9.0 | 8.8 | 8.9 | 8.6 | 8.5 | 7.9 | 7.5 | 7.2 |
| | 0.0567 | 9.0 | 8.9 | 8.8 | 8.6 | 8.4 | 8.0 | 7.6 | 7.3 |
| | 0.0680 | 9.0 | 8.9 | 8.8 | 8.7 | 8.4 | 8.0 | 7.6 | 7.3 |
| | 0.0907 | 9.1 | 8.9 | 8.9 | 8.7 | 8.4 | 8.0 | 7.6 | 7.3 |
| | 0.1133 | 9.1 | 8.9 | 8.9 | 8.8 | 8.4 | 8.0 | 7.6 | 7.3 |

As apparent from Table 6, the pH buttering capacity of the highly crosslinked polyacrylic fiber, which is restrained during the dyeing treatment, recovers to some extent even without the post-dyeing reduction treatment. But the reduction treatment brings back the pH buffering capacity with further certainty.

This application is based on application No. 2000-324749 filed in Japan, the content of which is incorporated herein by reference. In addition, each publication cited herein is specifically incorporated by reference in its entirety.

What is claimed is:

1. A pre-dyeing treatment process for a textile product that comprises highly crosslinked polyacrylic fibers wherein the crosslinks comprise amido and carboxylic acid groups which have been linked by a hydrazine, the treatment process comprising a step of immersing a textile product into a water solution of an organic acid and exposing the immersed product to a high temperature and an elevated pressure.

2. A process as described in claim 1, wherein the high temperature is between 105 to 140° C. and the elevated pressure is between 1.5 to 2 atmospheres.

3. A process as described in claim 1, further comprising washing the treated product with water.

4. A process as described in claim 2, further comprising washing the treated product with water.

5. A process as described in claim 3, further comprising drying the washed product.

6. A process as described in claim 4, further comprising drying the washed product.

7. A dyeing process for a textile product that comprises highly crosslinked polyacrylic fibers wherein the crosslinks comprise amido and carboxylic acid groups which have been linked by a hydrazine and another fiber, the process comprising:

immersing the textile product in a water solution of an organic acid and exposing the immersed product to a high temperature and an elevated pressure; and preferentially dyeing the other, non-highly crosslinked polyacrylic fiber.

8. The process of claim 7, wherein the high temperature is between 105 to 140° C. and the elevated pressure is between 1.5 to 2 atmospheres.

9. The process of claim 7, further comprising the steps of:

washing the treated textile product with water prior to dyeing.

10. The process of claim 8, further comprising the step of:

washing the treated textile product with water prior to dyeing.

11. The process of claim 9, further comprising the step of:

drying the washed textile product prior to dyeing.

12. The process of claim 10, further comprising the step of:

drying the washed textile product prior to dyeing.

13. An undyed textile product comprising highly crosslinked polyacrylic fibers wherein the crosslinks comprise amido and carboxylic acid groups which have been linked by a hydrazine with another fiber, prepared by a pretreatment process comprising:

immersing a textile product that comprises highly crosslinked polyacrylic fibers with another fiber into a water solution of an organic acid and exposing the immersed product to a high temperature and an elevated pressure; and then washing the product with water.

14. The product of claim 13, wherein the high temperature is between 105 to 140° C. and the elevated pressure is between 1.5 to 2 atmospheres.

15. The product of claim 13, wherein the pretreatment process further comprises drying after washing the treated product with water.

16. The product of claim 14, wherein the pretreatment process further comprises drying after washing the treated product with water.

17. A dyed textile product comprising highly crosslinked polyacrylic fibers wherein the crosslinks comprise amido and carboxylic acid groups which have been linked by a hydrazine and another fiber blended therein, prepared by a preferential dye treatment method of:

immersing a textile product that comprises said crosslinked polyacrylic fibers and another fiber blended therein in a water solution of an organic acid and exposing the immersed product to a high temperature and an elevated pressure; and thereafter dyeing the textile, wherein the fiber blended with the highly crosslinked polyacrylic fibers preferentially takes up dye.

18. The product of claim 17, wherein the high temperature is between 105 to 140° C. and the elevated pressure is between 1.5 to 2 atmospheres.

19. The product of claim 17, wherein the preferential dye treatment method further comprises washing the treated textile product with water prior to dyeing.

20. The product of claim 18, wherein the preferential dye treatment method further comprises washing the treated and exposed textile product with water prior to dyeing.

21. The product of claim 19, wherein the preferential dye treatment method further comprises drying the textile after washing with water and before dyeing.

22. The product of claim 20, wherein the preferential dye treatment method further comprises drying the textile after washing with water and before dyeing.

23. A mixture of a textile product in a water solution of organic acid, the textile product comprising highly cross linked polyacrylic fibers wherein the cross links comprise amido and carboxylic acid groups linked by a hydrazine and wherein the organic acid is in a range to sufficiently titrate the carboxylic acid groups.

24. The mixture of claim 23, wherein the organic acid is in a concentration of 0.02 to 0.06 moles per liter.

25. A process for preferential dyeing a first fiber in a textile that contains the first fiber as a blend with a second highly crosslinked polyacrylic fiber wherein the crosslinks in the second fiber comprise amido and carboxylic acid groups which have been linked by a hydrazine, comprising:

providing a textile with said blend of highly crosslinked polyacrylic fiber and another fiber;

immersing the textile in a water solution of an organic acid at a concentration of 0.02 to 0.06 moles per liter;

exposing the immersed textile to a high temperature of 105 to 140° C., an elevated pressure of 1.5 to 2 atmospheres, or both;

optionally rinsing the textile in water; and dyeing the textile in a conventional manner, thereby imparting more color to the first fiber than to the second highly crosslinked polyacrylic fiber.

26. A dyed textile comprising a blend of a highly crosslinked polyacrylic fiber wherein the crosslinks comprise amido and carboxylic acid groups which have been linked by a hydrazine with another more strongly dyed fiber, the textile prepared by the process of claim 25.

27. The dyed textile of claim 26, wherein the more strongly dyed fiber comprises a fiber selected from the group consisting of polyester, cationic dyeable polyester, polyamide, acrylic fiber, wool, cellulosic fiber and polyester/cellulose blend.

* * * * *